US011021879B2

(12) United States Patent
Bourne

(10) Patent No.: US 11,021,879 B2
(45) Date of Patent: Jun. 1, 2021

(54) WALL PANEL AND ASSOCIATED APPARATUS

(71) Applicant: Elekta Limited, West Sussex (GB)

(72) Inventor: Duncan Neil Bourne, Surrey (GB)

(73) Assignee: Elekta Limited, Crawley (GB)

( * ) Notice: Subject to any disclaimer, the term of this patent is extended or adjusted under 35 U.S.C. 154(b) by 83 days.

(21) Appl. No.: 16/183,672

(22) Filed: Nov. 7, 2018

(65) Prior Publication Data

US 2019/0136544 A1 May 9, 2019

(30) Foreign Application Priority Data

Nov. 8, 2017 (GB) ..... 1718487

(51) Int. Cl.
*E04F 13/08* (2006.01)
*B21D 28/26* (2006.01)

(52) U.S. Cl.
CPC ..... *E04F 13/0803* (2013.01); *B21D 28/26* (2013.01); *E04F 13/0851* (2013.01)

(58) Field of Classification Search
CPC . E04F 13/0803; E04F 13/0851; E04F 13/083; E04F 13/0833; E04F 13/0835; E04B 2/721; E04B 2002/7466; E04B 2/789; E04B 2002/7462; E04B 2002/7464; F16B 2/241
See application file for complete search history.

(56) References Cited

U.S. PATENT DOCUMENTS 2,019,110 A * 10/1935 Ball ..... B60R 13/02 52/511
2,044,216 A * 6/1936 Klages ..... E04F 13/0803 52/774

(Continued)

FOREIGN PATENT DOCUMENTS

DE 102007051095 A1 4/2009
GB 1475302 A * 6/1977 ..... E04B 2/789

(Continued)

OTHER PUBLICATIONS

UKIPO Search Report for International Application No. GB 1718487.0 from the United Kingdom Intellectual Property Office, dated Apr. 24, 2018.

*Primary Examiner* — Christine T Cajilig
(74) *Attorney, Agent, or Firm* — Finnegan, Henderson, Farabow, Garrett & Dunner LLP

(57) ABSTRACT

A wall panel comprising a front face, a return lip extending from at least one edge of the front face to define a flange lying behind the front face, and a mounting clip formed in the flange for attaching the wall panel to a support structure is provided. The mounting clip may comprise a curved formation, thereby having a distance from the front face that varies along its length. The formation may be shaped to include a local minimum distance. The mounting clip may be a tab or tongue defined by a U-shaped slot cut in the flange. The U-shaped slot can be located in the flange between a pair of through-holes or slots. According to other embodiments of the present disclosure, a device for shaping the mounting clips, and a method of assembling a paneled wall using the device to manufacture the mounting clips are provided.

11 Claims, 6 Drawing Sheets

(56) References Cited

U.S. PATENT DOCUMENTS

| | | | | | |
|---|---|---|---|---|---|
| 2,049,278 | A * | 7/1936 | Toussaint | E04F 13/0803 | 52/281 |
| 2,082,314 | A * | 6/1937 | Venzie | E04F 13/0812 | 52/506.09 |
| 3,621,635 | A * | 11/1971 | De Lange | E04F 13/083 | 52/235 |
| 4,441,297 | A * | 4/1984 | Rijnders | E04F 13/0803 | 52/478 |
| 6,148,585 | A * | 11/2000 | Baker | E04C 3/30 | 52/36.6 |
| 6,612,090 | B1 * | 9/2003 | Corden | E04F 13/0803 | 52/235 |

FOREIGN PATENT DOCUMENTS

| | | | | | |
|---|---|---|---|---|---|
| GB | 1532995 | A | 11/1978 | | |
| KR | 20060092739 | A | 8/2006 | | |
| KR | 20090009275 | U | 9/2009 | | |
| WO | WO-8701751 | A1 * | 3/1987 | E04B 2/7863 | |
| WO | WO-2012116786 | A2 * | 9/2012 | F24S 25/632 | |

* cited by examiner

WALL PANEL AND ASSOCIATED APPARATUS

CROSS-REFERENCE TO RELATED PATENT APPLICATIONS

This application claims the benefit of a United Kingdom Application No. GB 1718487.0, filed Nov. 8, 2017, which is hereby incorporated by reference in their entirety.

FIELD OF THE INVENTION

The exemplary embodiments of the present disclosure relate to decorative wall panels, arrangements for fixing the wall panels to supporting structures, and associated apparatus for forming the wall panels.

BACKGROUND

It is often desirable to give a pleasing, aesthetic appearance to a wall by attaching decorative panels to the wall or a supporting structure attached to a wall (both of which we shall refer to herein as a "wall"). This raises the question of how the panels are to be attached to the wall. Lightweight panels can be adhesively attached to the wall, but this makes removal difficult if repair or maintenance of the wall or structures within the wall becomes necessary. Screw-type fixings can be used, by drilling a hole through the panel, but this can be time-consuming if done accurately and may leave a result that is visually unappealing, even if efforts are made to conceal the heads of the screw-type fixings.

There are known forms of fixings which are not visible from the exterior face of the paneled wall and, thus, present an aesthetically-appealing finish, but these forms of fixings often require specialist tools to affix and remove the fixings. In addition, these forms of fixings often require precision in attaching the fixings to the wall, and skilled connection of the panel to the fixings. A conventional form of fixing includes a "Z" clip, which comprises a Z-shaped clip attached to a panel and a Z-shaped clip attached to a wall. The panel clip and the wall clip are shaped so that the panel clip can engage with the wall clip to support the panel in position.

For example, GB1532995 discloses a panel with a lip at the top and bottom of the panel, each lip being engageable with a corresponding push-fit-type connector attached to a wall. In use, one or both of the lips temporarily bend outwards as the panel is pushed against the corresponding connector. The resilience of the material of the panel provides an engagement force to hold the panel in place with respect to the connector. This disclosure provides certain desirable features, but also has certain drawbacks. For example, since a degree of bending of the panel is required to form an engagement with the wall connector, it is only feasible for each panel to have two lips. That would in practice limit the maximum vertical size of such a panel because there will be a maximum weight supportable by a connector and because a large panel made of a material suitable to engage a connector may warp along its vertical length if the vertical length is large.

SUMMARY

According to an embodiment of the present disclosure, a wall panel is provided. The wall panel may comprise a front face, a return lip extending from at least one edge of the front face to define a flange lying approximately parallel to and behind the front face, and a mounting clip in the form of a tab (e.g., a small projecting flap or strip of material) formed in the flange for attaching the wall panel to a support structure is provided. The mounting clip may comprise a curved formation, thereby having a distance from the front face that varies along its length. The formation may be shaped to include a local minimum distance. The front face, return lip, and flange may be formed integrally.

Such a panel can be mounted neatly onto a suitably-prepared surface without fixing means. Nevertheless, the fixing can be both secure against accidental disturbance and straightforward to undo, for example, for repair and maintenance purposes. The panel can be hung from a simple channel or series of channels fixed to the wall at a height appropriate for the mounting clip, such that the panel is very straightforward to install.

The formation can also be shaped to include a local maximum distance. This may accentuate the profile of the mounting clip, thereby allowing a more secure fitting.

The mounting clip may be a tab or a tongue, defined by a U-shaped slot cut in the flange and made of a suitably strong yet sufficiently resilient material, such as aluminium alloy or steel. This may be straightforward to manufacture, and yet provide a mounting clip that can be securely attachable to the flange while having a clearance around the mounting clip allowing the mounting clip to flex. The U-shaped slot can be located in the flange between a pair of through-holes or slots to assist with manufacture as will be set out in more detail below. The mounting clip may have a fixed end and a free end. The free end may substantially correspond to the apex of the U-shaped slot, and the fixed end may substantially be at the opposite end of the mounting clip. At the free end, there may be an end portion which may rest substantially in parallel with the front face of the panel. At the fixed end, the mounting clip may also tend to be substantially in parallel with the front face of the panel. Between the fixed end and the free end, the curved formation may be arranged. Such a formation may ideally be shaped so that the local minimum and maximum distances are located along the tongue with the local minimum distance closer to the free end. This may improve the strength of a connection between the mounting clip and a wall fixing, such as a channel.

The free end of the mounting clip may be displaced vertically from the proximate flange portion, i.e. the nearest portion of the flange beyond the mounting clip, or, in other words, the portion of the flange beyond the U-shaped slot facing the free end of the mounting clip. However, such vertical displacement between the free end of the mounting clip and the proximate flange portion may vary based on at least one of the width of the U-shaped slot, the method by which the mounting clip is shaped, the material selected for the panel itself, or other factors. The vertical displacement between the free end of the mounting clip and the proximate flange portion may be selectively varied.

The vertical displacement between the free end of the mounting clip and the proximate flange portion may be small. Advantageously, the vertical displacement between the free end of the mounting clip and the proximate flange portion may be less that the thickness of material forming the channel into which the mounting clip may be attached. Such an arrangement may ensure that, when the mounting clip is fully inserted into the corresponding channel, some of the proximate flange portion may be above the lowest part of the material forming the channel, thus providing a degree of resistance to horizontal displacement of the panel.

The tongue may have three or more curves. The presence of a plurality of curves may allow an increase in resilience, so as to provide a good connection between the mounting clip and a wall fixing.

The flange may lie spaced from the rear of the front face, so as to ease manufacture of both the flange and the mounting clip.

In some embodiments, a plurality of mounting clips may be formed in the flange. Further, there may be a plurality of flanges, each on different edges of the front face. In some aspects, the flanges may include at least one mounting clip, or a plurality of mounting clips.

The weight of the panel can be supported by a ledge, thereby allowing the mounting clips to retain the panel in place. Accordingly, the precise positioning of the mounting clips and the channel (or series of channels) may not be crucial, and thus, they may be formed or fitted quickly and easily. The low-down ledge may be fitted to a wall accurately, such that the final position of a number of adjacent panels can be accurate, consistent, and neat.

According to another embodiment of the present disclosure, the exemplary embodiments of the present disclosure may relate to a kit comprising at least one panel as described above, and a ledge for fitting the at least one panel to a wall. The kit may further comprise a plurality of panels. The ledge may be longer than the width of an individual panel, thereby allowing the ledge to support a plurality of panels at the same height.

According to another embodiment of the present disclosure, a device for shaping mounting clips is provided. The device may comprise a die block having a front face defining a desired shape for a first side of the clip, a punch defining a desired shape for a second and opposite side of the clip, and a drawing mechanism for drawing the punch toward the die block. The drawing mechanism may comprise a rotatable drive member extending from a rear face of the die block, through the die block to the punch and engaging with a screw-threaded element associated with the punch.

The device may also include a rotatable slave member, driven from the rotatable drive member, and which likewise extends through the die block to the punch and engages with a second screw-threaded element associated with the punch. This may allow a balanced draw to be exerted on the punch, while being driven from only a single torque input. The slave member can be driven by a belt drive extending from the drive member to the slave member. For ease of construction, the screw-threaded elements can be captive within the punch, or an integral part thereof. The drive member and the slave member may extend through the die block to the punch on either side of the desired shapes for the clip, thereby allowing a balanced draw and locating the die block and punch relative to the wall panel by engaging with pre-formed through-holes or slots in the wall panel.

The drive and slave member may be capable of being disengaged from the second screw-threaded element to allow the punch to be released after use.

The exemplary embodiments of the present disclosure also provide a method of paneling a wall using a device, as described above, to form at least one mounting clip on the flange of a wall panel and create a wall panel, as described above. The method may comprise attaching a channel adapted to receive the tab to the wall, and positioning and moving the wall panel relative to the wall so that the tab enters and engages with the channel, thereby fixing the panel to the wall. The method may further comprise providing a ledge on the wall below the channel, and moving the wall panel as the tab enters and engages with the channel so that a lower edge of the wall panel rests on the ledge.

BRIEF DESCRIPTION OF THE DRAWINGS

An embodiment of the present invention will now be described by way of example, with reference to the accompanying figures in which.

DETAILED DESCRIPTION OF THE EMBODIMENTS

Figure 1:
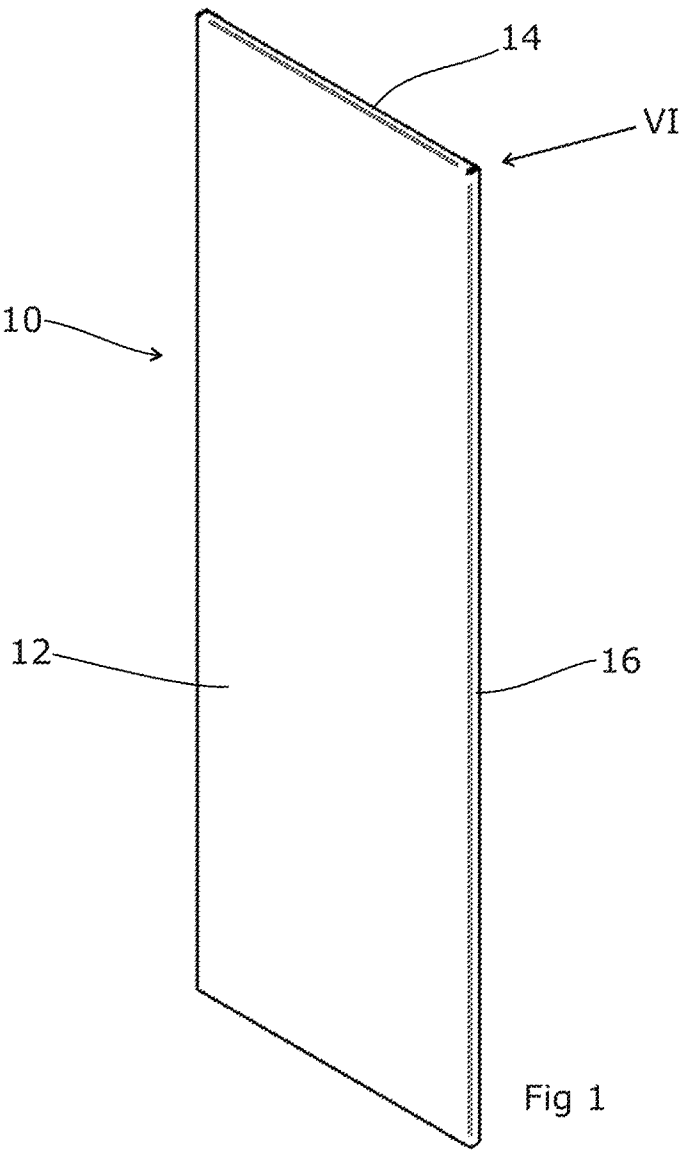
FIG. 1 shows a front perspective view of a panel according to the embodiments of the present disclosure.

FIG. 1 shows a wall panel 10 comprising a front face 12 and return lips at the top 14 and on the right-hand side 16. The wall panel 10 may also have a return lip at the left-hand side which is not shown in FIG. 1.

Figure 2:
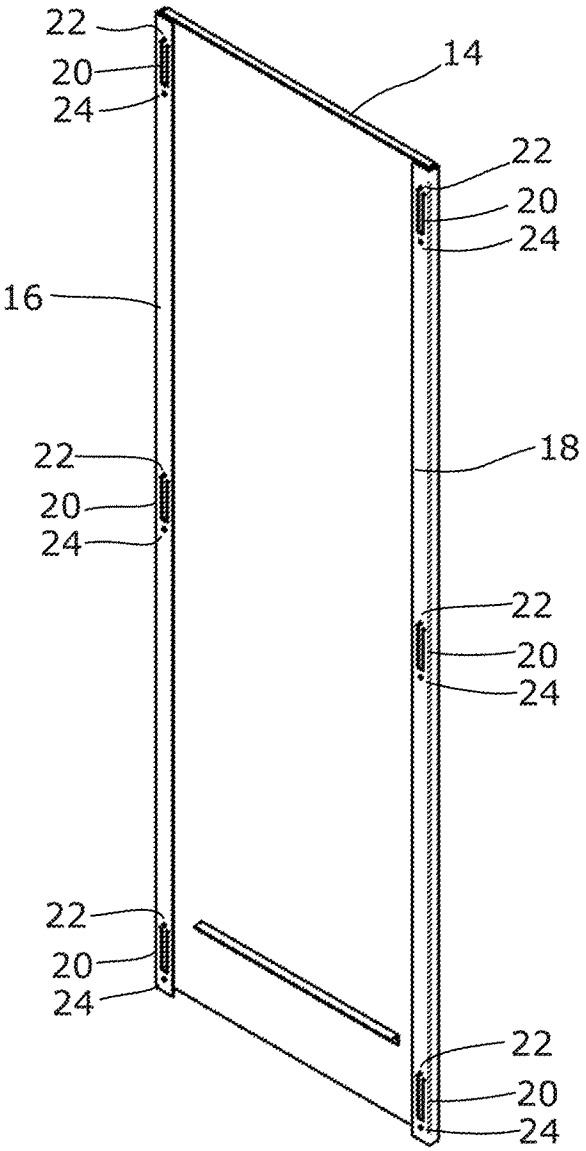
FIG. 2 shows a rear perspective view of a panel according to the embodiments of the present disclosure.

FIG. 2 shows a rear view of the wall panel 10. The panel 10 may comprise a return lip 14 at the top and return lips 16, 18 at each side. Each side lip 16, 18 may comprise three mounting clips 20 formed within it. Each of the mounting clips 20 may have an upper locating hole 22 and a lower locating hole 24. Towards the lower part of the wall panel 10 there may be a batten 26, which may provide additional stiffness to the panel 10 and may space the lower part of the panel 10 from the wall in use.

Figure 3:
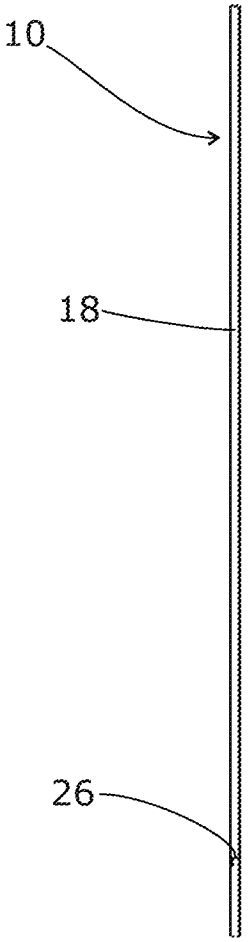
FIG. 3 shows a side view of a panel according to the embodiments of the present disclosure.

FIG. 3 shows a side view of the wall panel 10 with the return lip 18 visible. Batten 26 is shown in profile, although in practice it may not be visible behind the return lip 18.

Figure 4:
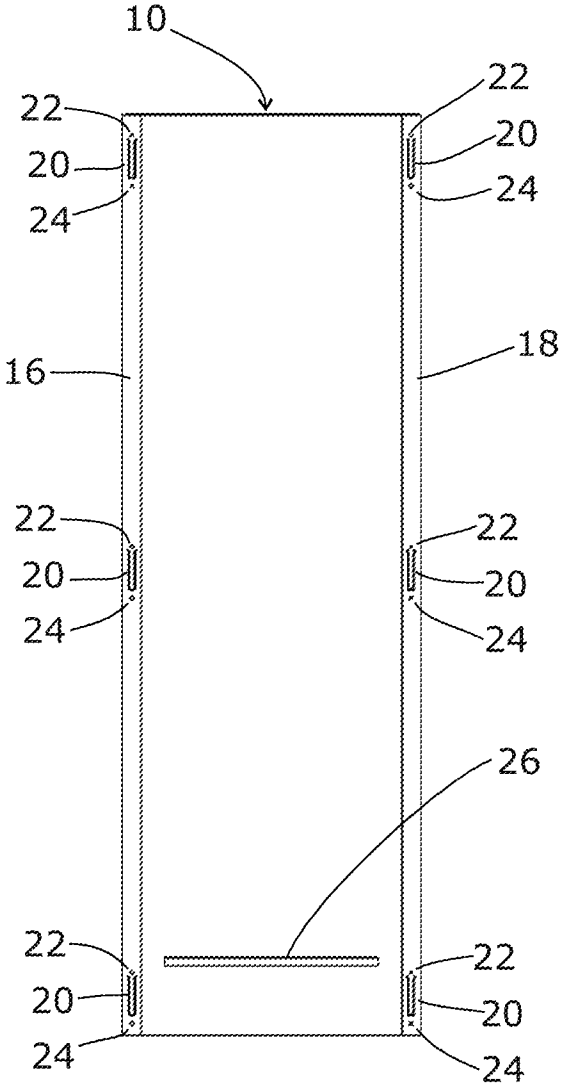
FIG. 4 shows a rear view of a panel according to the embodiments of the present disclosure.

FIG. 4 shows a rear view of the wall panel 10, as described with respect to FIG. 2.

Figure 5:
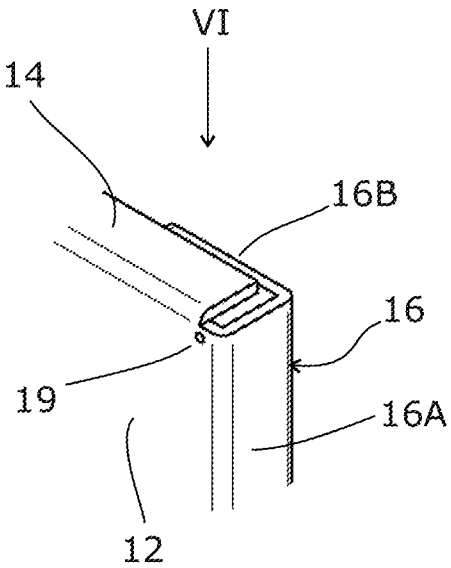
FIG. 5 shows a detail of the corner VI of FIG. 1.

FIG. 5 shows a detailed view of the corner VI labelled in FIG. 1 of the wall panel 10. Portions of the front face 12 and return lips at the top 14 and side 16 are shown. The piece of material forming the front face 12 may be formed with one portion bent around to form a flap-like portion at about a right angle to the front face 12 to form the top lip 14, with one portion 16A bent around at about a right angle to the front face 12, and with a further portion 16B bent around so that it lies approximately parallel to the front face 12. Portions 16A and 16B together may form side lip 16. Hole 19 may be provided close to the corner to cater for a pop-rivet or other earth connector, for use in rooms containing RF-generating equipment such as an MRI apparatus. This may allow the panel to be to electrically connected to ground or to a nearby Faraday cage structure, thereby preventing the panel from acting as a capacitor driven by RF energy in the room.

Figure 6:
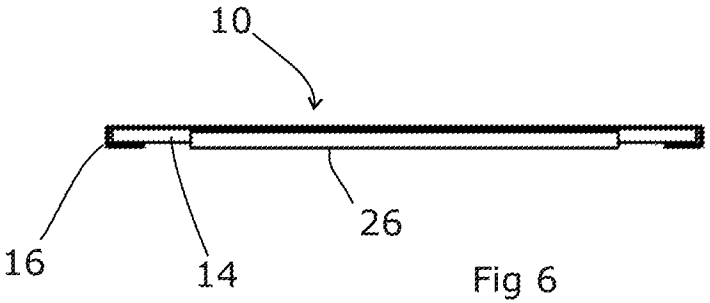
FIG. 6 shows a top view of a panel according to the embodiments of the present disclosure.

FIG. 6 shows a plan view of the same wall panel 10, with the return lips at the top 14 and side 16.

Figure 7:
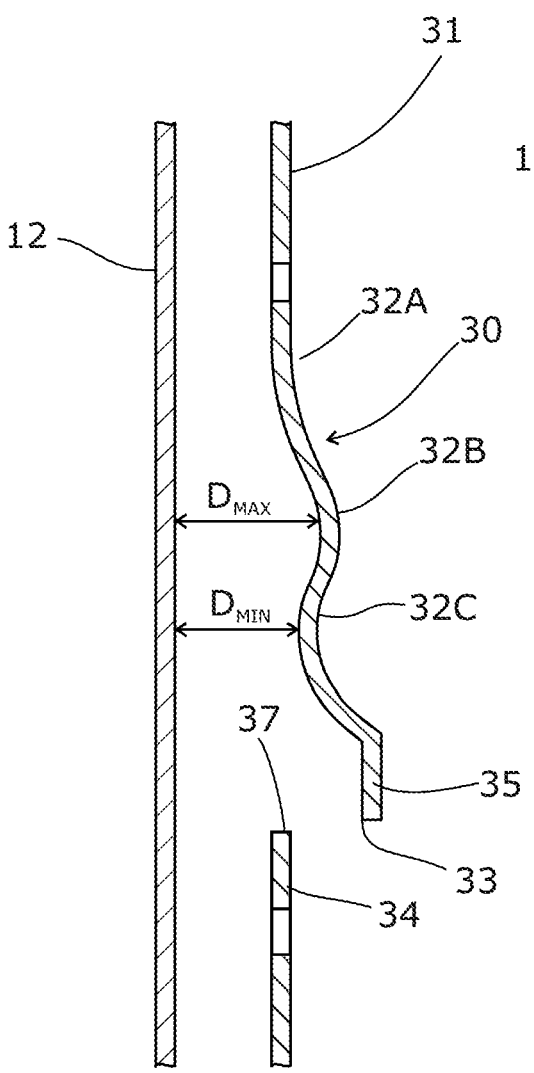
FIG. 7 shows a sectional view of a mounting clip of a panel according to the embodiments of the present disclosure.

FIG. 7 shows a detailed view of a mounting clip 30, in relation to certain parts of the panel, in accordance with the embodiments of the present disclosure. The mounting clip 30 may be in the form of a flat tab or tongue, and may be formed from a portion of a return lip which may form a flange as set out above. The plane of the flange may be substantially parallel to the front face 12. Thus, the mounting clip 30 may be spaced apart from the front face 12 of the panel. The mounting clip 30 may have a fixed end 31 and a free end 33. In the region of the free end 33, an end portion 35 may be provided, which lies substantially parallel to the front face 12 of the panel. Between the fixed end 31 of the mounting clip and the free end 33, a series of curves 32A, 32B, 32C may be provided, setting portions of the mounting clip 30 at differing distances from the front face 12 of the panel. The curves may be formed so that the mounting clip 30 may have a local minimum distance $D_{MIN}$ from the front face 12 of the panel and a local maximum distance $D_{MAX}$ from the front face 12 of the panel. The local minimum distance $D_{MIN}$ may be closer to the free end 33 than the local maximum $D_{MAX}$ may be to the free end 33. A further portion 34 of the return lip may also be shown to show the discontinuity of the mounting clip 30 from the rest of the return lip. The vertical displacement between the free end 33 of the mounting clip 30 and the proximate flange portion 37 of the return lip 34 may be small.

Figure 8:
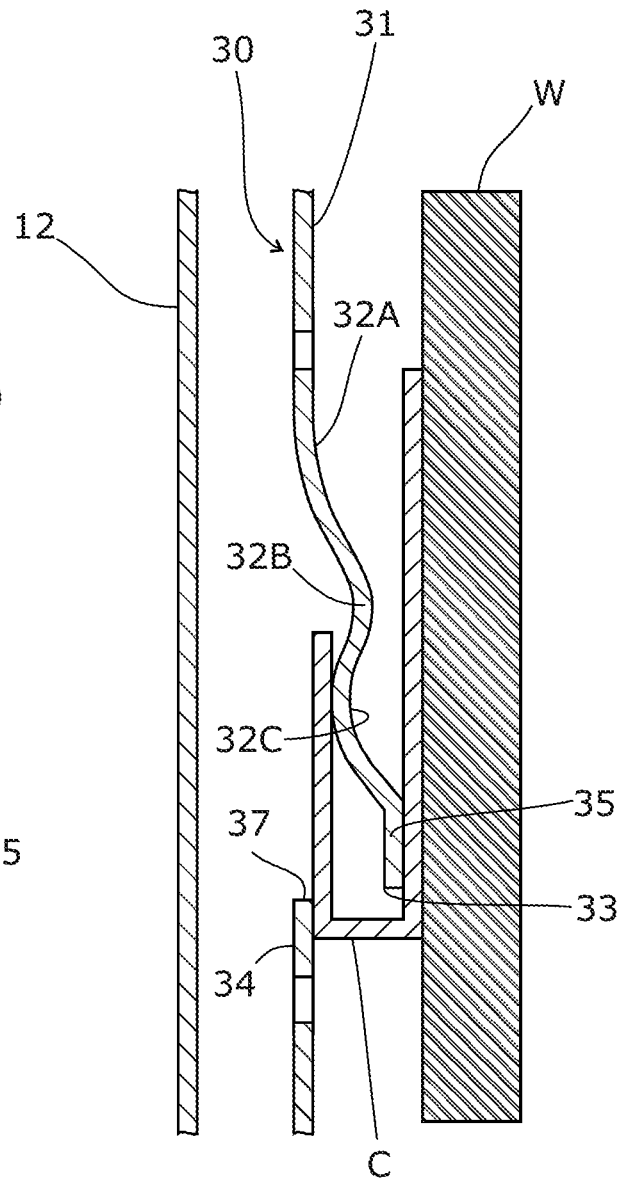
FIG. 8 shows the mounting clip of FIG. 7 after fitting the panel to a wall.

FIG. 8 shows the mounting clip 30 in a position in use with respect to a channel C attached to a wall W. Curves 32A, 32B, 32C may provide for engagement with the channel C at least at the local minimum distance $D_{MIN}$. The curves may also provide a spring-like force to urge the mounting clip 30 towards the front face 12 of the panel so as to hold the panel against the wall W. The vertical displacement between the free end 33 of the mounting clip 30 and the proximate flange portion 37 of the return lip 34 may be small. Thus, a portion of the return lip 34 may overlap the material forming the channel C vertically.

Figure 9:
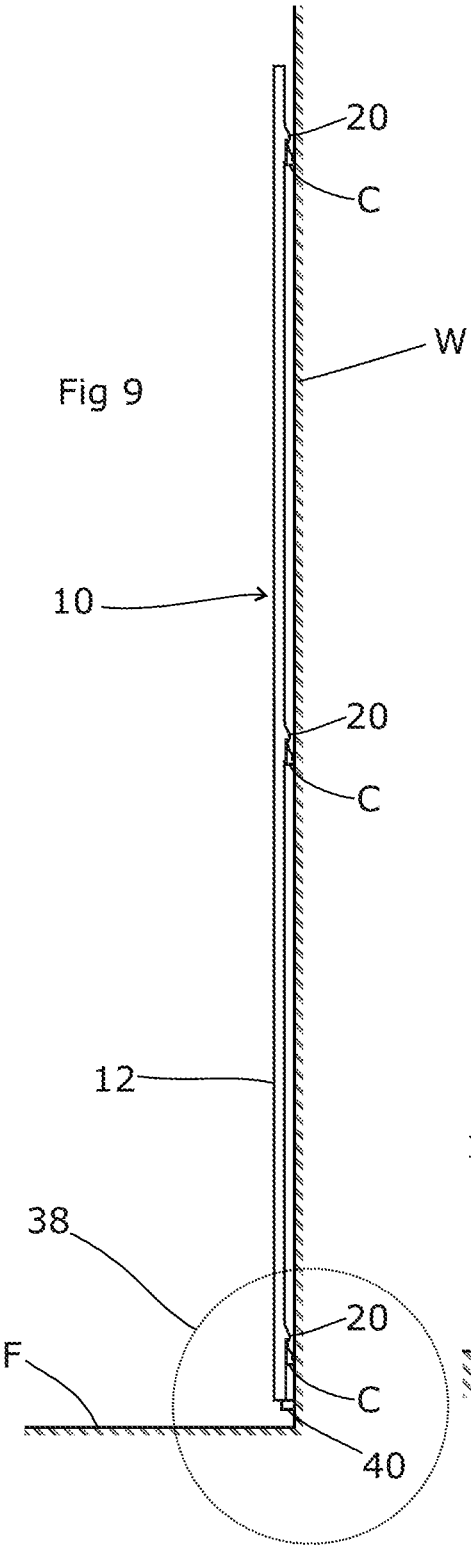
FIG. 9 shows a sectional view from the side of a panel fitted to a wall.
Figure 9A:
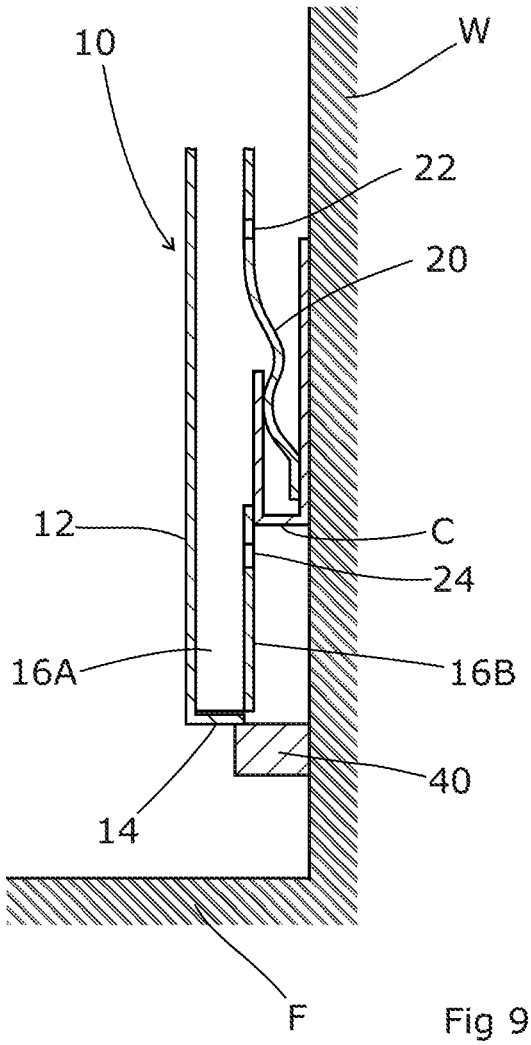
FIG. 9*a* shows an enlarged view of a portion of FIG. 9.

FIGS. 9 and 9*a* show the wall panel 10 attached in place to a wall W. FIG. 9*a* illustrates an enlarged view of the lower part 38 of the wall panel 10. Channels C may be affixed to the wall W in order to receive the mounting clips 20 and prevent the wall panel 10 from moving away from the wall W. At the lower edge of the wall panel 10, a ledge 40 may be affixed to the wall using a suitable technique such as an adhesive, or wall fixings such as screws secured in wall plugs appropriate to the type of wall W. The lower edge 14 of the wall panel may then rests on the ledge 40 to provide support for the wall panel 10, thereby supporting the weight of the panel 10.

Accordingly, a precise positioning of the mounting clips 20 and the channels C may not be crucial as they do not dictate the vertical alignment of the wall panel 10 or support its weight. As a result, the channels C can be fitted to the wall quickly and easily. It may be relatively straightforward to fit a ledge 40 to a wall at a low and accessible position with a high degree of accuracy, and the same ledge may extend beneath a number of adjacent panels, thus holding all panels at an accurate and consistent height to provide a neat appearance. Once the ledge and channels are in place and the tabs have been formed in the flanges of the wall panels (as described below), paneling the wall may be a quick and simple task. For example paneling the wall may comprise positioning each panel in turn and moving it downwards so that the tabs engage with the channels and the lower edge of the panel rests on the ledge. This arrangement may allow panels to slide horizontally so that they abut one another to provide a continuously paneled surface.

Figure 11:
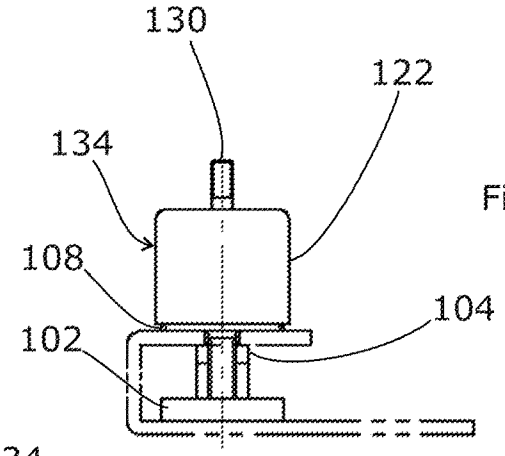
FIG. 11 shows a side view of the device of FIG. 9.
Figure 12:
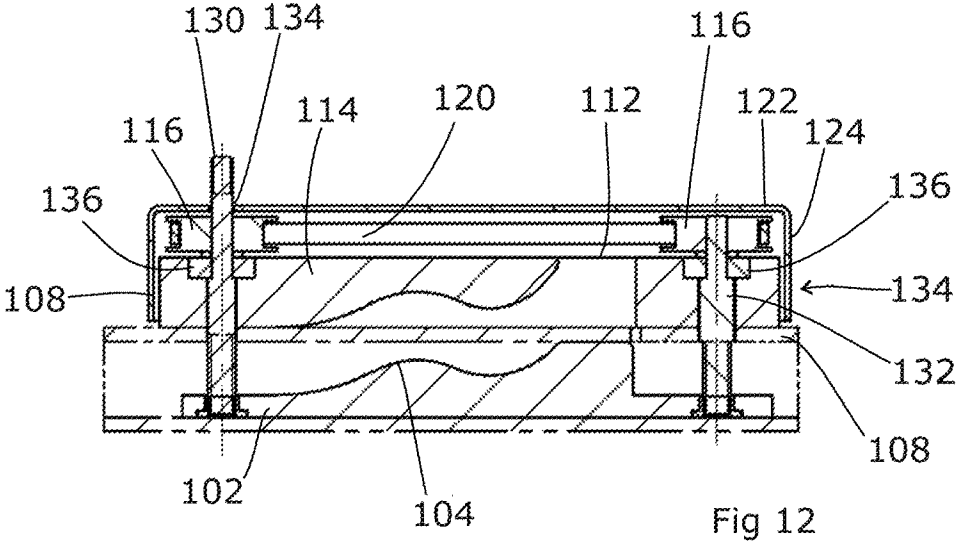
FIG. 12 shows a sectional view of the device of FIG. 9.
Figure 10:
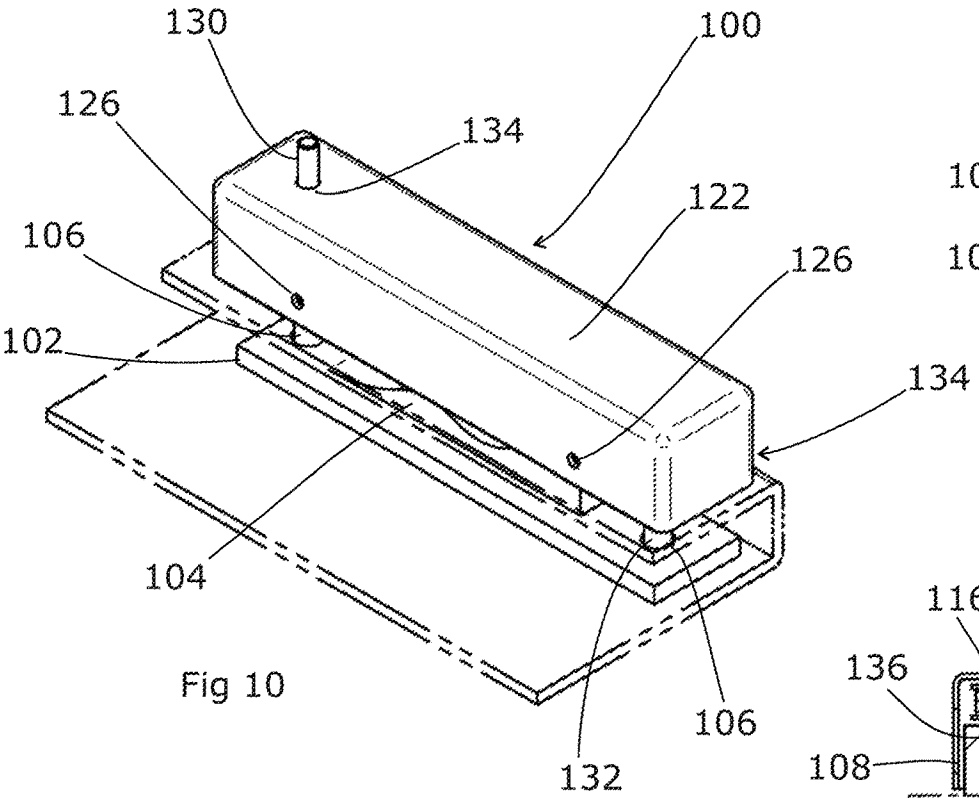
FIG. 10 shows a perspective view of a device for forming the mounting clip of FIG. 7.
Figure 13:
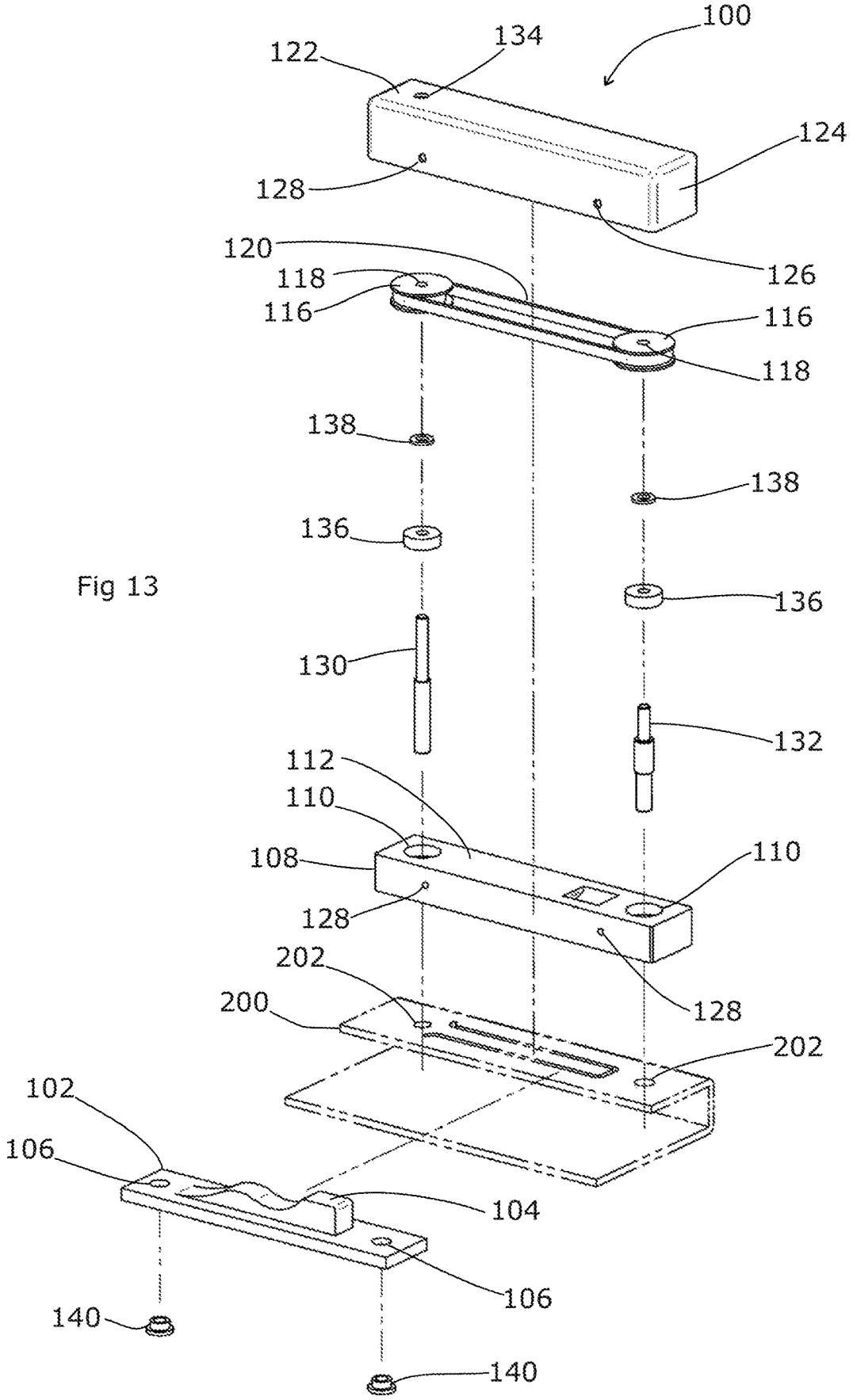
FIG. 13 shows an exploded view of the device of FIG. 9.

FIGS. 10 to 13 show different views of a device 100 for forming the mounting clip in accordance with the embodiments of the present disclosure. FIGS. 10 to 12 show the device 100 as arranged for use, and FIG. 13 shows the device 100 in exploded form to clearly show how the elements fit together. The device 100 may have a first die element 102 with a raised portion 104 which may be shaped to form a curved profile. The first die element 102 may have locating holes 106 at either end. A second die element 108 may have locating holes 110 at either end which may correspond to the locating holes 106 of the first die element 102. The second die element 108 may form an open-box-like structure—there being an opening on its under-side as shown in the figures. Extending into the space within the second die element 108 from an upper part 112 may be a raised portion 114 which may be shaped to form a curved profile. The profiles of the raised portion 104 of the first die element 102 and the raised profile 114 of the second die element 108 may correspond with each other and form corresponding first and second faces for defining a desired shape for a clip. The device 100 may have a pair of pulleys 116 linked by a belt 120. The pulleys 116 have drive holes 118 formed within them which correspond to the locating holes 106 and 110 of the first 102 and second 108 die elements, respectively. The device 100 may further comprise a cover 122 with walls 124 which may enclose the second die element 108 in use. The cover 122 may have locating holes 126 on at least one side, which may correspond to locating holes 128 on at least one side of the second die element 108. When assembled for use, the device 100 may have rods 130, 132 arranged through the locating holes 106, 110 and drive holes 118 of the first 102 and second 108 die elements and the pulleys 116, respectively. The rods 130, 132 may each be provided with a screw thread on the outside surface. The screwthread of rod 130 may be engageable with a corresponding screwthread on the inside surface of locating hole 134 of the cover 122 and with locating hole 106 of the first die element 102. Thus, a drawing mechanism may be provided in which the first die element 102 and the second die element 108 can be drawn together by rotation of rod 130. Rod 132 may engage with a corresponding screwthread in the corresponding locating hole 106 of the first die element 102. Thus, when rod 130 is rotated a drive force may be transmitted between pulleys 116 by belt 120 so that rod 132 is rotated as a slave member. This action may allow for a balanced draw to be exerted on the punch driven from only a single torque input. Washers 136, 138 may be positioned on rods 130, 132 between the second die element 108 and the spacers 116. Grubs 140 may be affixed to an under-side of the locating holes 106 of the first die element 102.

Thus, assembled for use, the cover 122, spacers 116 and second die element 108 may be held together with respect to one another by the rods 130, 132 and suitable locators

The invention claimed is:

1. A wall panel, comprising:

a front face;

a return lip extending from at least one edge of the front face, wherein the return lip defines a first flange lying approximately parallel to and behind the front face; and a first mounting clip, comprising a tab formed in the first flange and configured to attach the wall panel to a support structure;

wherein:

the first mounting clip further comprises a fixed end, a free end, an end portion in the free end that extends in a direction parallel to the front face, and at least three curves between the fixed end and the end portion such that a distance from the front face to the first mounting clip varies along a length of the at least three curves;

a first portion of the at least three curves is located closer to the end portion than a second portion and a third portion of the at least three curves and shaped to include a local minimum distance from the front face;

the second portion of the at least three curves is shaped to include a local maximum distance from the front face;

the end portion is disposed a distance greater than the local maximum distance from the front face; and the front face, the return lip, and the first flange are formed integrally.

2. The wall panel of claim 1, wherein the first mounting clip comprises a tongue defined by a U-shaped slot cut in the first flange.

3. The wall panel of claim 2, wherein the U-shaped slot is located in the first flange between a pair of through-holes.

4. The wall panel of claim 1, further comprising a material forming a channel, onto which the mounting clip is attached;

wherein a vertical displacement between the free end of the first mounting clip and a proximate portion of the first flange is less than a thickness of the material forming the channel.

5. The wall panel of claim 1, further comprising a plurality of second mounting clips formed in the first flange.

6. The wall panel of claim 1, wherein the first flange is spaced apart from a rear of the front face.

7. The wall panel of claim 1, further comprising a plurality of second flanges on different edges of the front face.

8. The wall panel of claim 7, wherein the second flanges comprise at least one mounting clip.

9. The wall panel of claim 8, wherein the second flanges comprise a plurality of second mounting clips.

10. A kit, comprising:

at least one wall panel, comprising:

a front face;

a return lip extending from at least one edge of the front face, wherein the return lip defines a first flange lying approximately parallel to and behind the front face; and a first mounting clip, comprising a tab formed in the first flange and configured to attach the wall panel to a support structure;

wherein:

the first mounting clip further comprises a fixed end, a free end, an end portion in the free end that extends in a direction parallel to the front face, and at least three curves between the fixed end and the end portion such that a distance from the front face to the first mounting clip varies along a length of the at least three curves;

a first portion of the at least three curves is located closer to the end portion than a second portion and a third portion of the at least three curves and shaped to include a local minimum distance from the front face;

the second portion of the at least three curves is shaped to include a local maximum distance from the front face;

the end portion is disposed a distance greater than the local maximum distance from the front face;

the front face, the return lip, and the first flange are formed integrally; and a ledge configured to be fitted to a wall.

11. The wall panel of claim 1, wherein the free end of the first mounting clip is vertically displaced from the first flange of the return lip.

* * * * *